US006212928B1

(12) United States Patent
Kim et al.

(10) Patent No.: US 6,212,928 B1
(45) Date of Patent: Apr. 10, 2001

(54) METHOD FOR MANUFACTURING THIN COLD ROLLED INNER SHIELD STEEL SHEET WITH SUPERIOR MAGNETIC FIELD SHIELDING PROPERTY

(75) Inventors: Ki-Ho Kim; Gyosung Kim; Chang-Hoon Lee; Sung-Yul Huh; Boeng-Joon Kim, all of Kyungsangbook-do (KR)

(73) Assignee: Pohang Iron & Steel Co., Ltd. (KR)

( * ) Notice: Subject to any disclaimer, the term of this patent is extended or adjusted under 35 U.S.C. 154(b) by 0 days.

(21) Appl. No.: 09/464,683

(22) Filed: Dec. 16, 1999

(30) Foreign Application Priority Data

Dec. 18, 1998 (KR) ..... 98-56290

(51) Int. Cl.[7] ..... B21B 27/06
(52) U.S. Cl. ..... 72/202
(58) Field of Search ..... 72/229, 200, 201, 72/202, 366.2

(56) References Cited

U.S. PATENT DOCUMENTS 3,977,913 * 8/1976 Cabo et al. ..... 72/200
4,016,740 * 4/1977 Gonda et al. ..... 72/364
5,329,688 * 7/1994 Arvedi et al. ..... 72/201
5,554,235 * 9/1996 Noe et al. ..... 72/366.2

FOREIGN PATENT DOCUMENTS 60-255924 12/1985 (JP) .
62-280329 12/1987 (JP) .
02166230 6/1990 (JP) .
0071422 10/1997 (KR) .

* cited by examiner

*Primary Examiner*—Rodney A. Butler
(74) *Attorney, Agent, or Firm*—Webb Ziesenheim Logsdon Orkin & Hanson, P.C.

(57) ABSTRACT

A method for manufacturing a thin cold rolled inner shield steel sheet for use in a braun tube is disclosed. With this method, a steel sheet with superior magnetic field shielding properties can be manufactured by carrying two steps of cold rolling without adding an expensive alloy element, and without using a special decarburizing facility such as OCA. The method includes the following steps. There is prepared a steel slab composed of, in wt %, 0.0025% or less of C, 0.05–0.25% of Mn, 0.05–0.15% of Si, 0.015 or less of Al, and a balance of Fe and other impurity elements. Then a hot rolling is carried out on the steel slab at a temperature of 910° C. or above. Then a first cold rolling is carried out, and a first annealing is carried out at above a recrystallization temperature. Then a second cold rolling is carried out at a reduction ratio of 25–45%.

2 Claims, 2 Drawing Sheets

PRIOR ART

METHOD FOR MANUFACTURING THIN COLD ROLLED INNER SHIELD STEEL SHEET WITH SUPERIOR MAGNETIC FIELD SHIELDING PROPERTY

FIELD OF THE INVENTION

The present invention relates to a method for manufacturing a thin cold rolled inner shield steel sheet for use in a braun tube. More specifically, the present invention relates to a method for making a thin, cold rolled inner shield steel sheet, in which an inner shield steel sheet with superior magnetic properties can be manufactured without adding an expensive alloy element and without using a special decarburizing facility such as OCA (open coil annealing).

BACKGROUND OF THE INVENTION

Generally, a material which is capable of shielding magnetic fields such as an external magnetic field, the earth magnetic field or the like is called magnetic shield. One example of the magnetic shields is the inner shield installed within a cathode ray tube 10 as shown in FIG. 1. If external magnetic fields such as the earth magnetic field or the like intrude into the cathode ray tube 10, then the electron beams are deflected from their paths, with the result that they cannot land on the relevant pixels after passing through a shadow mask 15. Consequently, a color spreading occurs on the screen so as to aggravate the picture quality. Therefore, it is necessary that the external magnetic fields be shielded to prevent straying of the electron beams. The inner shield is used for this very purpose.

In FIG. 1, reference code 14 indicates a frame, and 16 indicates a phosphor screen.

The cold rolled steel sheet for the inner shield is roughly classified into a soft material and a hard material. That is, in the inner shield manufacturing methods, there is the case where only a bending is carried out, and the case where a deep drawing is carried out. In the case where the bending is carried out, the deformation amount is not very large, and therefore, the formability is not very much required, so that a cold rolled steel sheet can be used without carrying out a recrystallization annealing. This material is called "hard material". In the case of the hard material, a cold rolled steel sheet is bent, and the recrystallization is made to occur during the blackening process, thereby securing the magnetic properties. In contrast to this, in the case where the deep drawing is carried out, a considerable amount of deformation is imposed, and therefore, the formability has to be superior. Because of this fact, a recrystallization annealing is carried out so as to improve the formability. However, in the case of the soft material, the formability is superior owing to the execution of the recrystallization annealing, but there is the disadvantage that the addition of the process step is accompanied by an increase of the manufacturing cost.

The most important characteristic which is required for the cold rolled inner shield steel sheet of the soft and hard kinds is the magnetic field shielding property. This property is decided by the permeability ($\mu$) and the coercive force (Hc). If the magnetic field shielding capability is to be ensured, there are required a high purity steel having a low impurity content, and a highly clean steel having a low level of non-metallic inclusions. Further, the grain size has to be made coarse during the manufacturing process. The conventional techniques which satisfy the above described requisites include (1) a decarburization annealing method, (2) a low temperature hot rolling method and (3) a strain annealing method.

(1) The decarburization annealing method is described in Japanese Patent Sho-62-280329. In this technique, a steel with a carbon content of 0.02% or less is used to carry out a hot rolling by adopting a low slab reheating temperature. Then a first cold rolling is carried out at a reduction ratio of 60% or more, and then, a decarburization annealing is carried out to lower the carbon content to 0.003% or less. Then a second cold rolling is carried out at a reduction ratio of 60% or less, and then, a final annealing is carried out at a temperature of above 650° C. In this method, after the first cold rolling, the decarburization is carried out to lower the carbon content so as to satisfy the required characteristics. In this method, however, a special decarburization facility such as the OCA (open coil annealing) is required, this being a disadvantage.

(2) In order to solve the above described problem of the decarburization method, Japanese Patent Hei-166230 discloses a low temperature hot rolling method. In this technique, 0.005–0.08 wt % of Ti is added into a steel with a carbon content of 0.005 wt %, and then, a low temperature hot rolling is carried out. Then a cold rolling is carried out, and then, an annealing is carried out at a temperature of above 620° C. In this technique, there is the advantage that a single step of cold rolling is carried out. However, the cold rolling reduction ratio is very high, and therefore, the grain size in the final product is very fine, and therefore, the magnetic properties are not superior. That is, as described in the example, the coercive force is more than 1.75 Oe, and therefore, a steel sheet with superior magnetic properties cannot be obtained.

Further, the expensive element Ti is added, and the hot rolling temperature is lower than the usual hot rolling temperature (720–800° C.). Accordingly, it is not easy to apply the method to a continuous hot rolling process.

(3) In order to solve the above described problems, Korean Patent Application No. 97-714422 proposes a strain annealing method. In this technique, a cold rolling and a recrystallization annealing are carried out, and then, a skin pass rolling is carried out. Then a strain annealing is carried out at a temperature of 660 720° C. In the case of this method, a coarse grain size can be obtained in spite of a single step of the cold rolling, and therefore, a cold rolled steel sheet with superior magnetic properties can be manufactured. However, when carrying out the strain annealing, the annealing temperature is relatively high, and therefore, the sticking phenomenon may occur during the batch annealing.

In order to solve the problems of the single round cold rolling method, Japanese Patent Gazette No. Sho-60-255924 proposes a method in which the cold rolling is carried out two times or more. In this method, a steel with a carbon content of 0.08% is used to carry out a hot rolling and a first cold rolling. Then a decarburization annealing is carried out to produce a recrystallized product with a carbon content of 0.01% or less. Thereafter, a second cold rolling is carried out at a reduction ratio of 5–17%, and then, a second annealing is carried out at a temperature of 680–800° C. Then finally a third cold rolling is carried out at a reduction ratio of 50% or more. In this technique, the magnetic properties are superior, but three steps of cold rolling and two steps of decarburization annealing and recrystallization annealing have to be carried out, with the result that this complicated method causes an increase in the manufacturing cost.

SUMMARY OF THE INVENTION

The present invention is intended to overcome the above described disadvantages of the conventional techniques.

Therefore it is an object of the present invention to provide a method for manufacturing a cold rolled inner shield steel sheet, in which a steel sheet with superior magnetic properties can be manufactured by carrying out two steps of cold rolling, without adding an expensive alloy element, and without using a special decarburizing facility such as OCA.

In achieving the above object, the method for manufacturing a thin cold rolled inner shield steel sheet with superior magnetic field shielding properties according to the present invention includes the steps of: preparing a steel slab composed of, in wt %, 0.0025% or less of C, 0.05–0.25% of Mn, 0.05–0.15% of Si, 0.015 or less of Al, and a balance of Fe and other impurity elements; carrying out a hot rolling on the steel slab at a temperature of 910° C. or above; carrying out a first cold rolling; carrying out a first annealing at above a recrystallization temperature; and carrying out a second cold rolling at a reduction ratio of 25–45%.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE INVENTION

A feature of the present invention is that a cold rolled inner shield steel sheet with superior magnetic properties can be manufactured by carrying out two steps of cold rolling without adding any expensive alloy element and without using a special decarburizing facility such as OCA. This is realized by organically combining the manufacturing conditions together with the composition system of the present invention. Therefore, the present invention will be described by distinguishing the steel composition and the manufacturing conditions.

First the steel composition according to the present invention will be described.

Carbon (C) is one of the most important elements of the steel composition. As the carbon content is increased, much of the permeability is decreased, and much of the magnetic degradation occurs due to the magnetic aging. Therefore, the lower the carbon content is, the more advantageous it is. However, the carbon content will be limited to 0.0025%, because it is the industrially massproducible limit.

Manganese (Mn) is added for preventing the re d shortness caused by sulphur which is unavoidably contained in the steel. Generally, Mn is required to be added in an amount of 0.05% or more. However, if the Mn content is raised, then the permeability is lowered, and the coercive force rises, thus degrading the magnetic properties. Therefore, its upper limit should be 0.25%.

Aluminum (Al) is added for the deoxidizing purpose. Further, Al is reacted with nitrogen to form AlN which makes the grain size fine. Therefore, if the magnetic field shielding effect is to be superior like in the present invention, the Al content needs to be limited. Accordingly, the Al content should be 0.015% or less.

Silicon (Si) is also added as a deoxidizing agent, and if the Al content is limited, then the deoxidation has to be carried out with Si. Further, if Si is added in a small amount, the permeability is improved, and therefore, the lower limit of the Si content should be 0.05%. But if its added amount is excessively larger, it could aggravate the adherence of the black oxide film, so that its upper limit should be 0.15%.

Besides the above described elements, unavoidable elements such as sulphur (S) and phosphorus (P) are contained in the steel, and these unavoidable elements should be limited to the usually manageable ranges.

Now the manufacturing conditions will be described.

Figure 1:
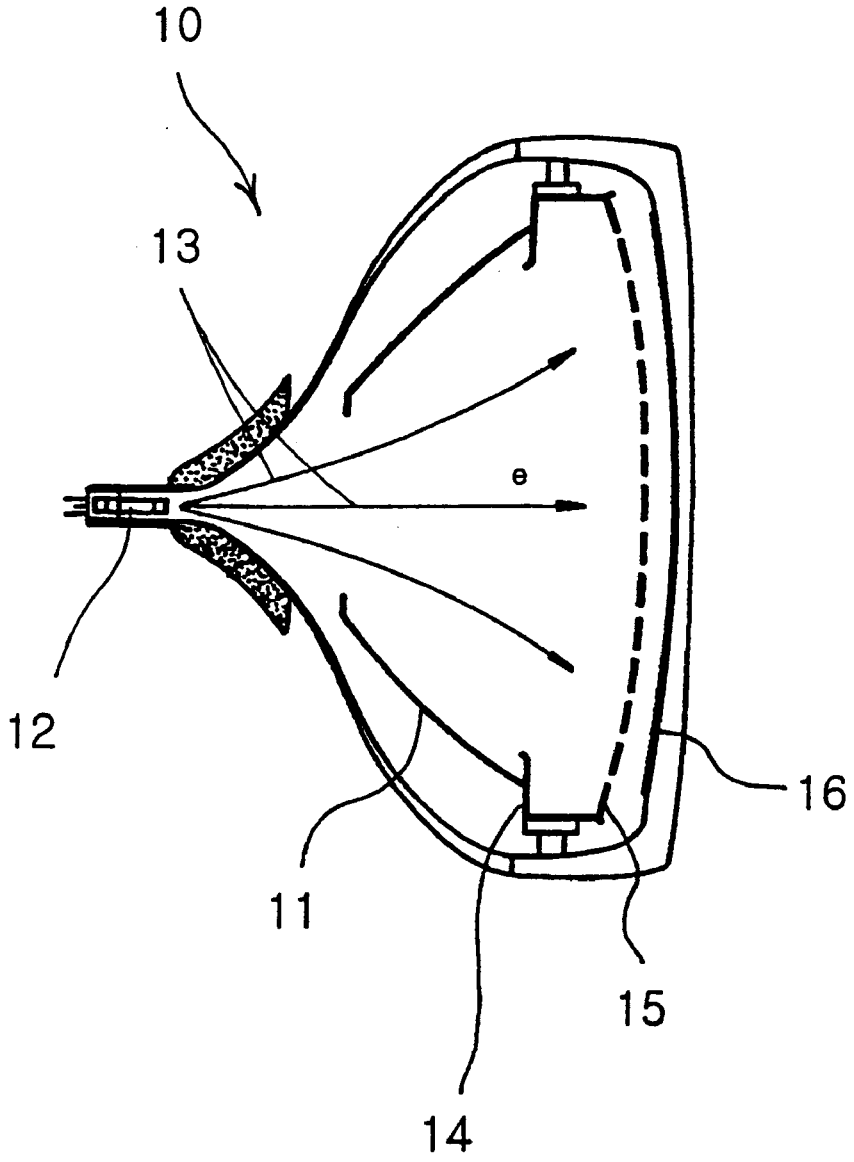
FIG. 1 is a schematic view showing the structure of a cathode ray tube.
Figure 2:
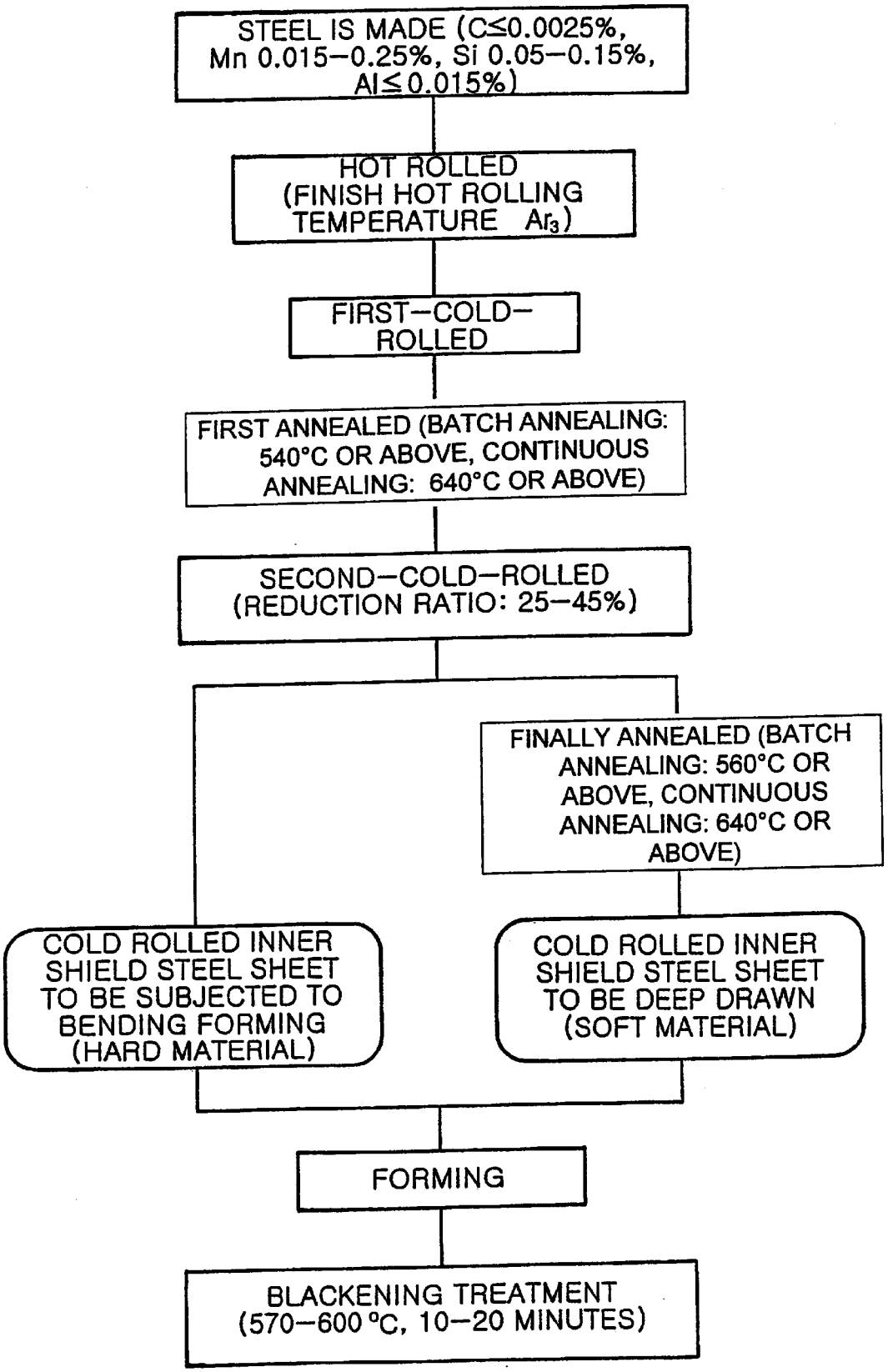
FIG. 2 illustrates the manufacturing process for the cold rolled inner shield steel sheet according to the present invention.

A steel slab is manufactured by using the above described steel and by applying a continuous casting process or an ingot casting process. This will be described in detail referring to FIG. 2.

The steel slab is hot-rolled after reheating it. Under this condition, the hot rolling is finished at a temperature of above 910° C., and the reason is as follows. That is, if its temperature is lower than the $Ar_3$, then ferrite is formed due to the phase transformation, with the result that the shape and thickness cannot be easily controlled during the rolling.

The hot rolled steel sheet is pickled and cold rolled, and a first annealing is carried out at a temperature above the recrystallization temperature. According to the research results of the present inventors, the recrystallization temperature is varied in accordance with the annealing method. In the case of the continuous annealing, it is about 610° C., while in the case of a batch annealing, it is about 540° C.

After the first annealing, a second cold rolling is carried out. The present invention is characterized in that the cold rolling reduction ratio under this condition is controlled to a range of 25–45%. If the cold rolling reduction ratio is too low, a recrystallization does not occur during the blackening treatment so as to make it difficult to secure adequate magnetic properties. On the other hand, if the cold rolling reduction ratio exceeds 45%, then the grain size becomes too fine, thereby degrading the magnetic properties. Meanwhile, the blackening treatment is carried out at the usual condition, that is, a heat treatment is carried out at a temperature of 570–600° C. for 10–20 minutes.

The product which has undergone the second cold rolling can be used as an inner shield steel sheet. In this case, a recrystallization has not occurred up to the inner shield forming step, and therefore, a bending process will be suitable as the forming process.

In the case where a deep drawing has to be carried out, a recrystallization annealing has to be carried out after the second cold rolling. In this case also, the recrystallization temperature is varied in accordance with the annealing method. That is, in the case of the continuous annealing, it is about 640° C., while in the case of the batch annealing, it is about 560° C.

Now the present invention will be described based on actual examples.

EXAMPLE 1

Steels with the compositions of Table 1 were melted, and were manufactured into cold rolled steel sheets at the conditions set forth in Table 2. Their properties were evaluated, and the results are shown in Table 2 below.

TABLE 1

| Steel | C | Mn | Si | Al | S | P | Classification |
|---|---|---|---|---|---|---|---|
| A | 0.0230* | 0.18 | 0.005* | 0.043* | 0.013 | 0.014 | Comparative steel |
| B | 0.0024 | 0.15 | 0.002* | 0.038* | 0.014 | 0.012 | " |
| C | 0.0018 | 0.16 | 0.240* | 0.009 | 0.013 | 0.012 | " |
| D | 0.0022 | 0.15 | 0.080 | 0.008 | 0.012 | 0.013 | Inventive steel |

*indicates those which depart from the conditions of the present invention.

TABLE 2

| Steel | Hot finish rolling temperature (° C.) | 1st rolling reduction ratio (%) | 1st cold annealing temperature (° C.) | 2nd rolling reduction ratio (%) | Properties: Blackened film adherence | Coercive force (HC) | Maximum permeability | Classification |
|---|---|---|---|---|---|---|---|---|
| Comparative steel A | 910 | 85 | 760 | 40 | good | 1.78 | 2952 | Comparative material |
| Comparative steel B | | | | | good | 1.65 | 3867 | Comparative material |
| Comparative steel C | | | | | degraded | 1.07 | 4567 | Comparative material |
| Inventive steel D | | | | | good | 1.21 | 4521 | Inventive material |

As could be seen in Table 2 above, although the manufacturing conditions fall within the ranges of the present invention, there were great differences of properties depending on the chemical compositions. First, in the case of the comparative steel A, the carbon content was very high, and therefore, the magnetic properties were greatly degraded. This was due to the fact that the added carbon formed carbides so as to aggravate the magnetic properties. In the case of the comparative steel B, although the carbon content was low, the Al content was high, and therefore, Al was reacted with N of the steel to form fine AlN precipitates, with the result that the grain size could not be made coarse. In the case of the comparative steel C, although the magnetic properties were superior, the blackened film had a low adherence. Therefore, when the inner shield was installed into the high vacuum cathode ray tube, the blackened film peeled off in pieces so as to impede the paths of the electron beams. Therefore, they all cannot be said to have proper chemical compositions.

In contrast to this, in the case of the inventive steel D in which the Si content was decreased compared with the comparative steel C, superior magnetic properties were maintained, and further, the blackened film adherence was superior. Therefore, it can be said that the inventive steel D had a proper chemical composition.

EXAMPLE 2

A steel with the chemical composition of Table 3 was manufactured at the conditions of Table 4. Then a blackening treatment was carried out by heat-treating the steel at a temperature of 580° C. for 10 minutes. Then the magnetic properties were checked, and the checked results are shown in Table 4.

TABLE 3

| Steel | C | Mn | Si | Al | S | P | Classification |
|---|---|---|---|---|---|---|---|
| E | 0.0023 | 0.12 | 0.12 | 0.013 | 0.008 | 0.011 | Inventive steel |

TABLE 4

| Steel | Hot finish rolling temperature (° C.) | 1st cold rolling reduction ratio (%) | 1st annealing temperature (° C.) | 2nd rolling reduction ratio (%) | Magnetic Properties: Coercive force (Hc) | Maximum permeability | Classification |
|---|---|---|---|---|---|---|---|
| Inventive steel E | 915 | 90 | 740 | 20* | 1.96 | 3118 | Comparative material 1 |
| | | | | 25 | 1.09 | 5970 | Inventive material 1 |
| | | | | 35 | 1.22 | 4408 | Inventive material 2 |
| | | | | 40 | 1.29 | 4041 | Inventive material 3 |
| | | | | 57* | 1.59 | 3269 | Comparative material 2 |

*indicates those which depart from the conditions of the present invention

As could be seen in Table 4 above, the second cold rolling reduction ratio at which the magnetic properties were superior corresponded to a range of 25–40% (based on the criteria that the coercive force was 1.30 Oe, and the maximum permeability was 4000 gauss). The reason why superior magnetic properties could be attained only at a particular range of the cold rolling reduction ratio was thought to be as follows. That is, if the second cold rolling reduction ratio is too low, then the recrystallization cannot occur sufficiently during the blackening treatment, and therefore, the strain energy which has been imposed during the cold rolling cannot be completely restored, with the result that the magnetic properties are degraded. On the other hand, if the cold rolling reduction ratio is too high, even if the recrystallization occurs, the grain size becomes fine, and therefore, the magnetic properties are aggravated.

The cold rolled inner shield steel sheet which was manufactured in the above described manner showed an elongation of 2–4%, because the recrystallization did not occur when press forming was performed. Accordingly, this steel sheet was not suitable for a deep drawing or the like, but could be used as a bending formation inner shield steel sheet.

EXAMPLE 3

Inventive materials 1, 2 and 3 were manufactured at conditions set forth in Table 4, and then, a recrystallization annealing and a blackening treatment were carried out. Then the mechanical properties and the magnetic properties were measured, and the measured results are shown in Table 5 below.

TABLE 5

| Classification | Final annealing temperature (° C.) | Mechanical properties | | | Magnetic properties | |
|---|---|---|---|---|---|---|
| | | Yield strength (MPa) | Tensile strength (MPa) | Elongation (%) | Coercive force (Hc) | Maximum permeability |
| Inventive material 1 | 640 (Batch annealing) | 183 | 332 | 42 | 1.05 | 5396 |
| Inventive material 2 | | 191 | 341 | 43 | 1.18 | 5231 |
| Inventive material 3 | | 197 | 345 | 41 | 1.25 | 4154 |

As shown in Table 5, the improvement of the magnetic properties owing to the recrystallization annealing was not high, but the mechanical properties, particularly the elongation was greatly improved by it, such that an elongation of 40% or more could be obtained. It was practically confirmed that, with this level of elongation, there was no problem in carrying out a deep drawing.

According to the present invention as described above, a cold rolled inner shield steel sheet with superior magnetic properties can be manufactured with only two steps of cold rolling but without a decarburization annealing. Therefore, the economy is improved compared with the conventional methods.

What is claimed is:

1. A method for manufacturing a thin cold rolled inner shield steel sheet with superior magnetic field shielding properties, comprising the steps of:

preparing a steel slab composed of, in wt %, 0.0025% or less of C, 0.05–0.25% of Mn, 0.05–0.15% of Si, 0.015 or less of Al, and a balance of Fe and other impurity elements;

carrying out a hot rolling on the steel slab at a temperature of 910° C. or above;

carrying out a first cold rolling;

carrying out a first annealing at a temperature above a recrystallization temperature; and carrying out a second cold rolling at a reduction ratio of 25–45%.

2. The method as claimed in claim 1, further comprising the step of carrying out a second annealing at a temperature above the recrystallizing temperature subsequent to the second cold rolling step.

* * * * *

UNITED STATES PATENT AND TRADEMARK OFFICE

CERTIFICATE OF CORRECTION

PATENT NO. : 6,212,928 B1
DATED : April 10, 2001
INVENTOR(S) : Ki-Ho Kim et al.

It is certified that error appears in the above-identified patent and that said Letters Patent is hereby corrected as shown below:

Column 2,
Line 35, between "660" and "720°C" insert -- hyphen (-) --.

Column 3,
Line 43, "massproducible" should read -- mass-producible --.
Line 44, "re d" should read -- red --.

Columns 5-6, Table 2,
Under column headed "Maximum permeability", under row headed "Comparative steel B", "3867" should read -- 3367 --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*